United States Patent [19]

Hardin et al.

[11] 4,129,996

[45] Dec. 19, 1978

[54] VENT SYSTEM FOR A SELF-CONTAINED AIR CONDITIONER

[75] Inventors: Louis W. Hardin; Lawrence D. Taylor, both of Louisville, Ky.

[73] Assignee: General Electric Company, Louisville, Ky.

[21] Appl. No.: 834,562

[22] Filed: Sep. 19, 1977

[51] Int. Cl.[2] ..... F25D 23/12; F25D 17/06

[52] U.S. Cl. ..... 62/262; 62/427

[58] Field of Search ..... 62/262, 427; 98/32

[56] References Cited

U.S. PATENT DOCUMENTS

| | | | |
|---|---|---|---|
| 3,022,647 | 2/1962 | Mullin | 62/262 |
| 3,264,843 | 8/1966 | Ulich | 62/427 |
| 3,643,461 | 2/1972 | Jacobs | 62/427 |
| 3,762,182 | 10/1973 | Loos et al. | 62/427 |
| 3,792,593 | 2/1974 | Loos et al. | 62/262 |

*Primary Examiner*—Lloyd L. King

*Attorney, Agent, or Firm*—Frank P. Giacalone

[57] ABSTRACT

A self-contained air conditioner unit of the type divided into indoor and outdoor chambers and, more particularly, to a venting system including a duct having an air directional valve system wherein in a vent mode a first passageway is provided for directing a portion of outdoor air being recirculated by the condenser fan into the indoor chamber, and a second passageway arranged in the no-vent mode to provide a substantially unobstructed outdoor air flow to the condenser.

7 Claims, 4 Drawing Figures

VENT SYSTEM FOR A SELF-CONTAINED AIR CONDITIONER

BACKGROUND OF THE INVENTION

1. Field Of The Invention

According to the present invention, there is provided a room air conditioner having a housing divided by an interior barrier into an indoor and an outdoor chamber. The evaporator or cooling means of the air conditioner is mounted in the indoor chamber and the condenser unit is mounted in the outdoor chamber. Air moving means are provided in both compartments for circulating air therethrough. In order for air to flow between chambers, thereby obtaining venting of outside air into the interior being conditioned, a venting system is provided. To control the air flow through the venting system an air valve is provided.

2. Description Of The Prior Art

Many room or area air conditioners provide vents or apertures in the barriers dividing the housing into separate compartments through which fresh outdoor air may be introduced from the outside into the room to be mixed with room air being recirculated through the evaporator. In one prior art venting system, as disclosed in U.S. Pat. No. 2,535,775-Ashley, a duct system is disclosed wherein the condenser fan moves a desired volume of outside air through the duct to the interior chamber of the unit where it is mixed with interior air being circulated by the evaporator fan. In another prior art venting system as disclosed in U.S. Pat. No. 3,022,647-Mullin a separately movable unitary air duct means is cooperatively joined to the air conditioning unit to selectively convey a portion of the outdoor air flowing through the condenser air circuit into the indoor space being conditioned, and in such close proximity to an inlet air opening of the evaporator air flow circuit as to be drawn into such opening, whereby the outdoor air is mixed with and discharged into the room air being conditioned.

In another prior art venting system disclosed in U.S. Pat. No. 3,792,593-Loos, a duct including a damper door is arranged in cooperative relationship with the evaporator blower scroll housing for allowing the blower wheel to draw a portion of the outside air being drawn into the unit housing when the damper is in one position, and in another position presents minimal obstruction turbulence to the flow of outside air being drawn into the condenser chamber by the condenser fan.

SUMMARY OF THE INVENTION

A self-contained air conditioning unit, including housing provided with a partition that divides it into an indoor and an outdoor chamber. A condenser is arranged in the outdoor chamber with an evaporator being arranged in the indoor section. The condenser is provided with a shroud forming a condenser chamber. A duct communicating between openings in the shroud and partition provides a first passageway between the condenser chamber and the interior chamber. The duct has openings in its side walls that provide a second passageway therethrough. An air directional control is associated with the duct and includes an air valve system for alternatively permitting air flow through said first and second passageway.

It is an object of the present invention to provide an air directional system wherein in a vent mode a direct passageway is provided between the condenser chamber and the interior chamber so that a portion of the outdoor air under pressure of the condenser fan is directed to the interior chamber to be mixed with recirculating indoor air, and in a no-vent mode a second passageway is provided so that the flow of outdoor air drawn by the condenser fan through the exterior compartment is substantially unobstructed.

DESCRIPTION OF THE PREFERRED EMBODIMENTS

Figure 1:
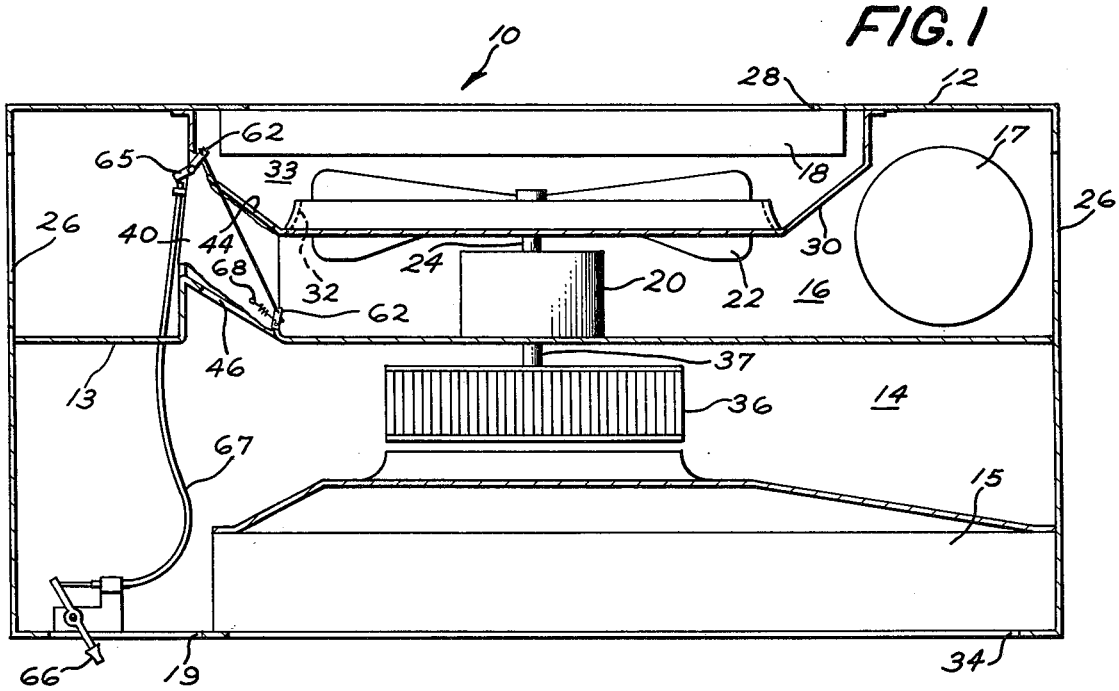
FIG. 1 is a plan view of the self-contained air conditioning unit showing an embodiment of the present invention.

Referring to the drawings and more particularly to FIG. 1, there is shown a self-contained room air conditioner 10 having a housing 12 adapted to be mounted in a window or other aperture of a room or area to be conditioned. The space within the housing is divided by a barrier or partition 13 into two compartments or chambers designated the inner or evaporator chamber 14 and the outer or condenser chamber 16. The housing 12 is normally positioned through the wall of a structure containing the area to be conditioned such that the inner chamber 14 is adjacent the area to be conditioned and the outer chamber 16 projects toward the outside.

Within the outer chamber 16 of the conditioner 10 there is positioned the refrigeration condensing unit or portion of the conditioner. This condensing unit comprises a refrigeration compressor 17 and a condenser 18 connected together by means of a compressor discharge line (not shown). A fan motor 20 supported on the partition 13 has a fan 22 mounted on one end of a motor shaft 24 which draws in outside air via suitable intake openings 26 through condenser 18 and discharge openings 28. A condenser shroud 30 is provided with a fan orifice 32 to define a condenser air chamber 33.

In order to cool or condition the room air there is provided within the inner compartment 14 an evaporator 15 connected in refrigerant flow relationship with the compressor 17 and condenser 18. Air is drawn from within the room through an inlet 34 by an evaporator fan or air moving means 36 mounted on the other end of motor shaft 37 which projects into chamber 14. The air stream is drawn into the evaporator chamber 14 from the room and passes through the evaporator 15 and is discharged back into the room through the discharge opening 19.

As thus far described, however, the air conditioner with its two separate compartments and condensing means forms no part of the present invention and is intended only to be illustrative of the type of air conditioner to which the invention may be adapted. As will now be fully explained, the invention deals with a venting system and the structure incorporated therewith for directing a portion of air circulated by the condenser fan 22 into the evaporator or inner chamber 14.

In order to bring fresh air from the outside to be mixed with the recirculated room air, there is provided a duct 40 including a passageway designated by broken line 42 that extends within the chamber 16 and serves to connect condenser chamber 33 with inner chamber 14. The passageway 42 or duct 40 connects at one end with an opening 44 in shroud 30 and at its other end with an opening 46 in partition 13. Since the air or condenser air chamber 33 is under slight pressure, a portion of outdoor air drawn into chamber 33 is forced through passageway 42 to chamber 14 within the zone of influence of fan 36 thereby permitting the supply of a regulated amount of outdoor air to the room being conditioned. In effect, the fans 22 and 36 are placed in series to supply the desired fresh air to the room being conditioned.

One of the principal features of the present invention results from the fact that the duct 40 when not being used to provide outside air for venting purposes provides a minimum of obstruction to the flow of outside air being drawn into the outer chamber 16 by the condenser fan 22 for movement through orifice 32 in shroud member 30. This is especially important when due to the amount of outside air necessary for proper venting requires a duct having a substantially large cross sectional dimension. This together with the limited amount of space available in chamber 16 causes the relatively large duct to impede or interfere with the free flow of air through the outer chamber 16 and condenser 18.

In the present embodiment it was determined that the outside air mixed with the indoor air be approximately 20 percent of the total air being recirculated by evaporator fan 36. In this instance, with the evaporator fan 36 employed delivering between 250 and 300 CFM, it required that the condenser fan 22 deliver between 50 to 60 CFM of outside air through the duct 40. It should be understood that while this amount of outside air was used for venting purposes, in this embodiment other proportions of outside vs. inside air can be employed. The present system can also be used effectively for providing cooling without energizing the refrigeration system, outside temperature permitting. In this instance the outside air delivered by the condenser fan 22 might be as high as 50 to 60 percent of the total air being recirculated by the evaporator fan 36, in which case the cross sectional dimension of the duct 40 might, by necessity, be large enough to cause some obstruction or turbulence to outside air being drawn into the outer chamber 16 by the condenser fan 22.

The means for providing a minimum of obstruction to the outside air drawn through the exterior chamber 16 by the condenser fan 22 includes providing a second passageway designated by broken line 52 in duct 40 that is transverse of passageway 42.

Figure 2:
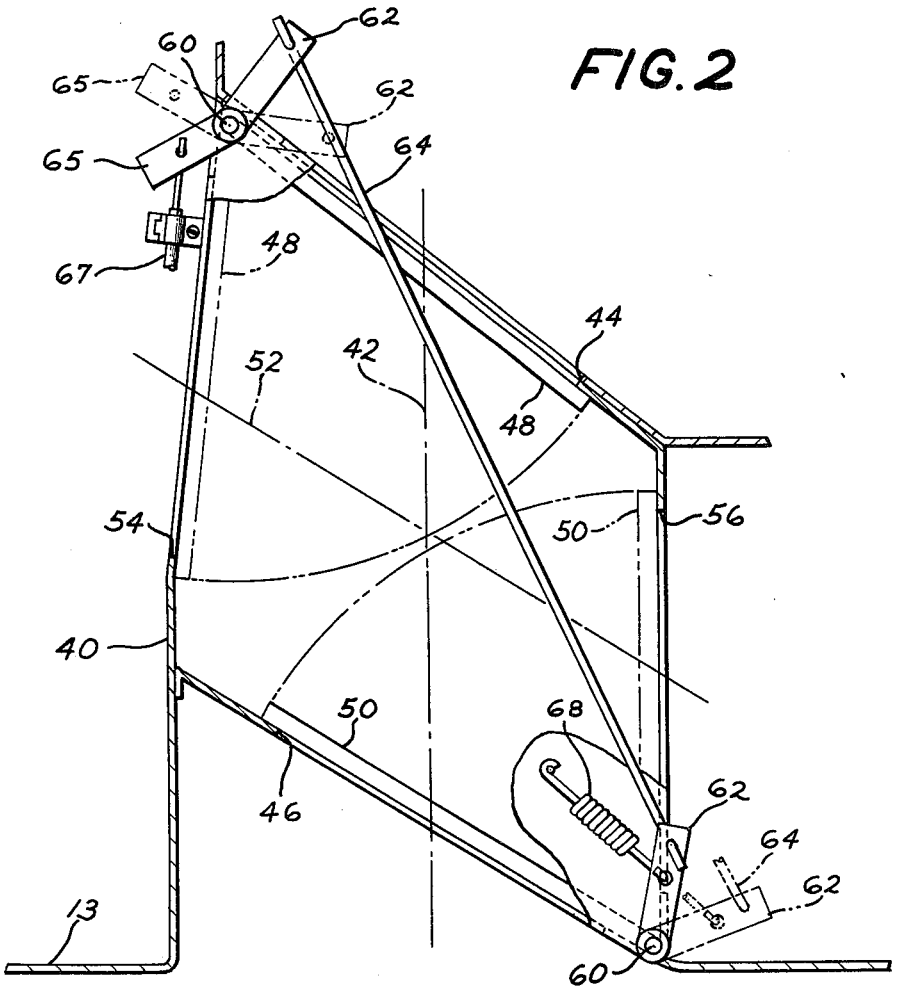
FIG. 2 is an enlarged fragmentary plan view showing the embodiment of FIG. 1.

To this end the duct 40 is provided with a pair of apertures 54 and 56. As shown in FIG. 2, in the venting mode air using passageway 42 passes between chamber 33 and chamber 14, through openings 44 and 46. However, in the no-vent mode means are provided to close apertures 44 and 46 and, accordingly, air flow is provided through apertures 54, 56 and passageway 52. With the apertures 54 and 56 being dimensioned to cover a relatively large area of the sidewalls of duct 40, the passageway 52 provides a path for the outside air therethrough that is substantially unobstructed by the presence of duct 40.

By the present invention means are provided for controlling the flow of air flowing through the passageway 42 so as to provide venting in one mode while providing an unrestricted flow of air through passageway 52 and the condenser in the other mode. The means for controlling the flow of air in the vent, no-vent mode is in the presence of an air valve system which is arranged relative to the venting apertures 44, 46 for allowing air flow through passageway 42, and apertures 54, 56 for allowing air flow through passageway 52.

There are shown two embodiments for controlling the air valve system of the present invention for directing air flow alternatively through passageway 42 or 52.

In the embodiment of the air valve shown in FIG. 2 there are associated with the apertures 44 and 46 doors 48 and 50 respectively which are mounted, as will be explained in detail, such that their movement controls the flow of air alternatively either through passageway 42 or 52. Each of doors 48 and 59 is hingedly supported at 60 so as to rotate from a no-vent position over their respective apertures 44, 46, as shown in FIG. 2, or to its fully open position, shown in dotted lines, substantially parallel to the vertical side wall of the duct 40 and over the apertures 54, 56 to block air flow through passageway 52.

In operation, it will be understood that the condenser fan 22 maintains air in chamber 33 under slight compression. Since duct 40 connects the chamber 33 with interior chamber 14, the opening of doors 48 and 50 relative to apertures 44, 46 causes the condenser fan to force or urge a desired quantity of outside air under compression through duct 40, passageway 42, and into the evaporator chamber 14 where it is brought within the zone of influence of the evaporator fan 36 and passed through the evaporator with the room air.

In the no-vent mode the doors 48 and 50, as mentioned hereinbefore are arranged over their respective apertures 44, 46 so that the apertures 54, 56 are open. With apertures 54, 56 being open, the condenser fan 22 can draw an uninterrupted flow of air through passageway 52, chamber 16, and condenser 18.

The mechanism for moving doors 48 and 50 between their vent, no-vent position in this embodiment is shown in FIGS. 1 and 2. The hinge 60 includes a portion that extends through the top wall of duct 40. Secured to the top end of each hinge 60 is a link 62 which is interconnected by a member 64. The member 64 causes the doors 48 and 50 to move together between their open and closed positions. The link 62 associated with door 48 is a bell crank including an arm 65. Extending from arm 65 to a control lever 66 mounted in the front opening 19 is a control wire or cable 67. The control lever 66 is rotatably mounted so as to be moved between a vent, no-vent position.

In the no-vent position, the control lever 66 is rotated counterclockwise to its position shown in the drawings. Through cable 67, bell crank arm 65, arms 62 and connecting member 64, the doors 48 and 50 are positioned as shown over the apertures 44 and 46, respectively, closing off passageway 42, and the outside air being drawn through the unit by fan 22 is allowed to flow substantially unobstructed by duct 40 through passageway 52. In the vent mode the control lever 66 is rotated clockwise to its dotted line position in FIG. 1, and the doors 48, 50 are rotated to their position over their respective apertures 54, 56 as shown in dotted lines in FIG. 2, closing off passageway 52, and a portion of the outside air is allowed to flow through passageway 42 to be mixed with the recirculating indoor air. The air flow system doors 48, 50 in the present embodiment are biased in the no-vent or air flow mode by a spring 68 which maintains the doors 48, 50 over their respective apertures 44, 46.

Figure 3:
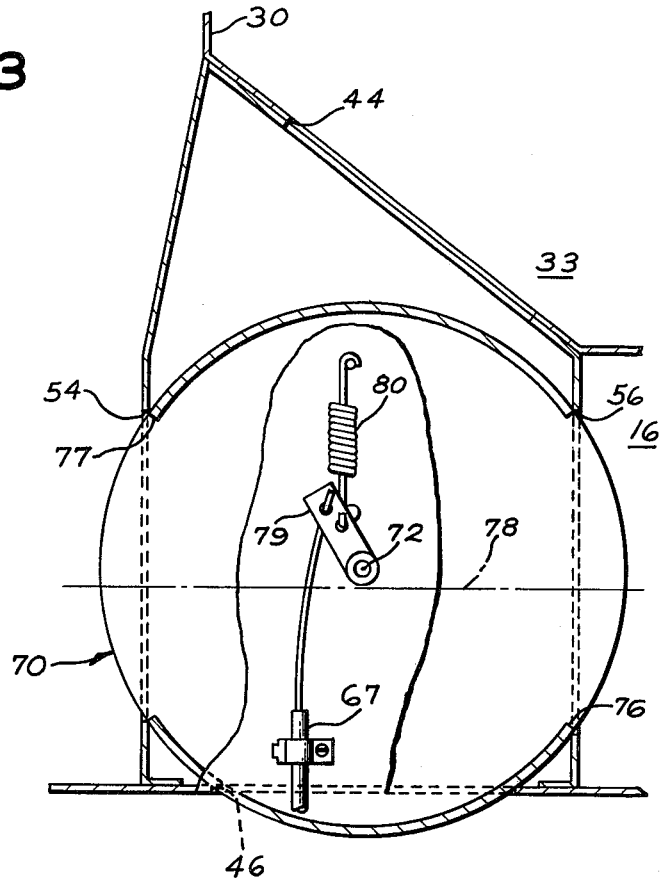
FIG. 3 is an enlarged fragmentary plan view similar to FIG. 2 showing a second embodiment of the invention.
Figure 4:
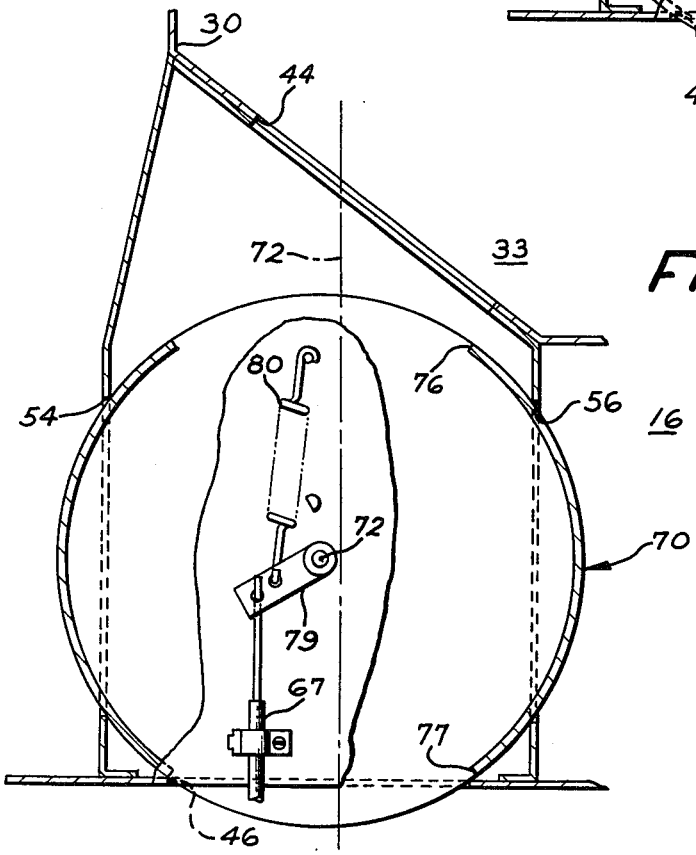
FIG. 4 is similar to FIG. 3 showing a second operating position.

Referring now to FIGS. 3 and 4, there is shown a second embodiment of the air valve system wherein parts identical to those of the embodiment of FIGS. 1 and 2 are shown by the same numerals. The air valve is a rotating drum or turret type air valve member 70. The member 70 is substantially cylindrical in shape and is mounted for rotational movement in the duct 40 which in this instance has been modified to cooperatively receive member 70. The circumferential wall 74 of the member 70 is formed with diametrically arranged openings 76 and 77 that provide a passageway 78 therethrough which is indicated by broken lines.

Projecting from the vertically disposed ends of the member 70 are axially arranged bottom (not shown) and top pivot pin 72. The pivot pin 72 extends through the top wall of the duct 40 and has secured thereon an arm 79. Secured to the arm 79 is one end of the operating cable 67 which is connected at its other end to control lever 66.

In the no-vent position shown in FIG. 3, the member 70 is rotated so that the passageway 78 is aligned with openings 54 and 56 and the outside air being drawn through the unit by fan 22 is allowed to flow substantially unobstructed by duct 40 through passageway 78. In the vent mode, the member 70 is rotated so that the passageway 78 is aligned with openings 44, 46 and a portion of the outside air is allowed to flow through passageway 78 to be mixed with the recirculating indoor air. The member 70 in this embodiment is biased in the no-vent mode of FIG. 3 by a spring 80.

Accordingly, by the present invention there is provided an effective air valving and directional control system including a properly dimensioned duct that in one mode allows a predetermined amount of outside air to be introduced and mixed with recirculating indoor air while providing an unobstructed flow of air in the no-vent system that is not substantially impeded by the presence of the duct.

The foregoing is a description of the preferred embodiment of the invention and variations may be made thereto without departing from the true spirit of the invention as defined by the appended claims.

What is claimed is:

1. In a self-contained air conditioning unit, including a housing, a partition within said housing dividing said housing into interior and exterior chambers; a condenser disposed within said exterior chamber adjacent an outlet in said casing and said evaporator being disposed in said interior chamber; a condenser shroud member including an opening forming a condenser compartment; a fan in said opening to pass exterior air between an inlet in said housing through said condenser to said outlet and for compressing air in said condenser compartment; a second fan in said interior chamber to recirculate interior air through said evaporator, the improvement comprising:

a duct providing a first passageway extending between an opening in said condenser shroud and an opening in said partition, pressure of air in said condenser compartment being sufficient to force a portion of exterior air through said first passageway into the interior evaporator chamber wherein said second fan moves said portion of exterior air through said evaporator with said recirculating interior air;

said duct being provided with first and second openings arranged to provide a second passageway for an air flow path transversely through said duct between said inlet and said opening in said shroud member;

air directional control means associated with said duct including air valve means movably arranged relative to said passageways for alternatively permitting air flow through said first or second passageway.

2. The invention defined in claim 1 wherein said air directional control means includes actuating means connected to said air valve means for positioning said valves in a first position for allowing air flow between said openings in said shroud and said partition and through said first passageway, while preventing air flow between said first and second opening in said duct and through said second passageway and a second position for allowing air flow between said first and second openings in said duct and through said second openings in said shroud and said partition and through said first passageway.

3. The invention defined in claim 2 wherein said valve means include a first valve member mounted for movement between said first opening in the wall of said duct and said shroud opening;

and a second valve member mounted for movement between said second opening in the wall of said duct and said partition;

said actuating means interconnecting said valve members for positioning said first and second valve members in a first position over said openings in said shroud and said partition, respectively, so that exterior air is circulated through said second passageway and a second position over said first and second duct openings so that said portion of exterior air is directed through said first passageway into said interior chamber and recirculated with said interior air.

4. The invention defined in claim 3 wherein said first and second valve members are hingedly mounted in said duct for vertical rotation between said first and second position.

5. The invention defined in claim 4 wherein said actuating means includes:

hinge means connected to said valve members having a portion extending through the upper wall portion of said duct;

arms attached to said hinge portions being interconnected to move together;

cable means connected between one of said arms and a rotatably mounted control means so that movement of said control means is effective to rotate both of said valve members between their first and second position.

6. The invention defined in claim 2 wherein said air directional control means associated with said duct includes a substantially cylindrical air valve member rotatably arranged in said duct; said air valve member including an opening forming a longitudinal passageway therethrough, said actuating means being connected to said cylindrical valve member for positioning said longitudinal passageway in one position in alignment with said first passageway to provide air flow between said opening in said shroud and said partition and in a second position in alignment with said first and second duct openings to provide substantially unobstructed air flow through said duct.

7. The invention defined in claim 6 wherein said cylindrical air valve member is arranged for rotation about a vertical axis;

pivot means on said axis having a portion extending through the upper wall portion of said duct;

an arm attached to said pivot means;

cable means connected between said arm and a rotatably mounted control means so that movement of said control means is effective to rotate said valve member between its first and second position.

* * * * *